US006189165B1

(12) United States Patent
Burton

(10) Patent No.: US 6,189,165 B1
(45) Date of Patent: Feb. 20, 2001

(54) COTS AND ADJUSTING DEVICES FOR COTS

(75) Inventor: Carl Burton, Rudry (GB)

(73) Assignee: G & S Safety Products Limited (GB)

( * ) Notice: Under 35 U.S.C. 154(b), the term of this patent shall be extended for 0 days.

(21) Appl. No.: 09/180,969

(22) PCT Filed: May 20, 1997

(86) PCT No.: PCT/GB97/01368

§ 371 Date: Dec. 15, 1998

§ 102(e) Date: Dec. 15, 1998

(87) PCT Pub. No.: WO97/43930

PCT Pub. Date: Nov. 27, 1997

(30) Foreign Application Priority Data

May 20, 1996 (GB) ..... 9610544
Jun. 5, 1996 (GB) ..... 9611744

(51) Int. Cl.[7] ..... A61F 13/00
(52) U.S. Cl. ..... 5/93.1; 5/513; 5/658
(58) Field of Search ..... 5/2.1, 93.1, 513, 5/658

(56) References Cited

U.S. PATENT DOCUMENTS 633,112 * 9/1899 Bartlett ..... 5/513 X
2,036,394 * 4/1936 Butler ..... 5/513
2,471,691 * 5/1949 Hurst ..... 5/513 X
2,659,904 * 11/1953 McGinnis ..... 5/513 X
2,686,922 * 8/1954 Vigne ..... 5/513 X
4,178,926 * 12/1979 Cohn ..... 5/513
4,890,346 * 1/1990 Rist ..... 5/513 X
5,867,850 * 2/1999 Mariol ..... 5/513 X

FOREIGN PATENT DOCUMENTS 810 258 3/1959 (GB) .
2 113 987 8/1983 (GB) .
2 307 401 5/1997 (GB) .
2 309 161 7/1997 (GB) .

* cited by examiner

*Primary Examiner*—Terry Lee Melius
*Assistant Examiner*—Frederick Conley
(74) *Attorney, Agent, or Firm*—Merchant & Gould P.C.

(57) ABSTRACT

A cot includes a base, a pair of side walls and a pair of end walls extending above the base. A transverse wall is detachably secured across the cot above the base between the side walls at a position partway along the length of the cot and serves to reduce the effective length of the cot.

18 Claims, 6 Drawing Sheets

COTS AND ADJUSTING DEVICES FOR COTS

Figure 1:
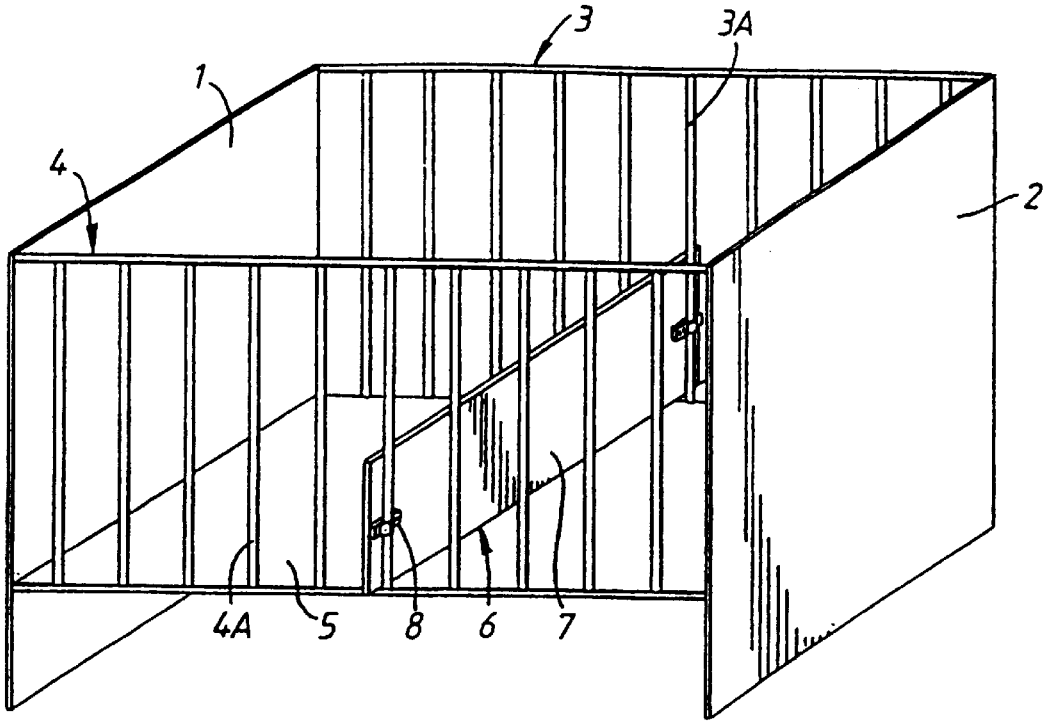

This invention relates to cots. More particularly the invention relates to a cot whose effective length is adjustable, to a cot adjusting device for adjusting the effective length of a cot and to a method of adjusting the effective length of a cot.

The length of a conventional cot is chosen having regard to the biggest child that the cot is designed to receive. In principle, the greater the length of the cot, the older the child can be whilst still being comfortable in the cot and therefore there are good reasons for a designer of a cot to make the cot as long as possible. That, however, gives rise to a problem when the child is much smaller and the length of the child is much less than that of the cot. If the bedding for the cot is arranged as it would be for a bigger child, then the smaller child will be placed in the cot with its head at one end of the cot and its feet will then be at a middle region of the cot; there is then nothing to stop the child shifting a substantial distance down the cot during a night's sleep and perhaps waking up at the end of the night with its feet at the bottom of the cot; in that case the child's head may be completely smothered by the bedding. In order to alleviate the problem just mentioned, the bedding for a smaller child may be arranged to allow for the child's head to be in a middle region of the cot, with the bedding covering the child extending between the middle and the bottom of the cot; that is a better arrangement but it is not problem-free: for example, the child may shift up the cot during the night and become uncovered by the bedding or may pull the bedding up over its head. A further disadvantage of both the arrangements just described is that the child's head may be in a middle region of the cot and it is not unusual to provide a mattress with a waterproof cover in that middle region. Such an arrangement is clearly dangerous and may even lead to cot death.

It is an object of the invention to provide a cot, an adjusting device for a cot and a method of adjusting a cot that overcomes or mitigates the problems referred to above.

The present invention provides a cot including a base, a pair of side walls and a pair of end walls extending above the base, and a transverse wall movably secured across the cot above the base between the side walls at a position partway along the length of the cot, the transverse wall serving to reduce the effective length of the cot.

Preferably the transverse wall is detachably secured across the cot.

With such a cot, the transverse wall can be secured in position for a smaller child but, after the child has grown or when a longer child is to be accommodated, the transverse wall can be moved or removed. Preferably the transverse wall defines the effective bottom end of the cot for the child's feet.

Preferably the transverse wall is securable across the cot in a plurality of different positions along the length of the cot. Thus the effective length of the cot may be adjusted to any one of a plurality of different lengths. The effective length of the cot may even be continuously variable although such fine adjustment of the length is not normally required.

Whilst the transverse wall may be secured in the cot in any appropriate way, it is preferably detachably secured to the side walls of the cot. The device chosen for detachably securing the transverse wall may be of any suitable kind but is preferably one designed to be fixed and released quickly.

The side walls of the cot may include a plurality of upright bars and in that case the transverse wall is preferably secured in place by the bars of the side walls of the cot. The transverse wall may be secured in place by opposite ends of the wall fitting between adjacent bars of the cot and also pressing outwardly against the side walls of the cot, and/or by fastening devices fastening the opposite ends of the wall to bars of the cot.

The transverse wall may be arranged to be detached from the cot by movement of the wall relative to the cot in a direction towards the top end of the cot, that being the opposite direction to that in which a child will apply pressure to the transverse wall when it is located at the child's feet.

Preferably the transverse wall is secured to the cot in a manner that prevents vertical movement of the transverse wall when it is fully secured. Such an arrangement enables the transverse wall to be clamped on top of bedding in the cot, squashing the bedding so as to prevent any part of a child extending beyond the transverse wall.

There may be no need for the transverse wall, which is designed for use when a child is small, to extend above the base as far as the end and side walls and the height to which the transverse wall extends above the base of the cot may be substantially less than the height to which the side walls and end walls extend above the base. The transverse wall should be sufficiently high to reduce the effective length of the cot; by keeping the height of the wall as low as reasonable, the size and weight of the wall is reduced making it easier to handle.

Whilst the transverse wall may be made of an open framework construction like the sides of many cots and the ends of some cots it is preferably substantially solid and indeed the ends of the cot are preferably substantially solid. There is then no opportunity for a part of a child to pass through the wall and perhaps become caught in it.

Preferably the transverse wall extends across substantially the whole distance from one side wall to the other. The length of the transverse wall is preferably adjustable to allow the wall to be fixed to any one of a variety of cots. The feature of length adjustability may be provided in any appropriate way; for example, the transverse wall may be formed of members slidably connected together. In one embodiment of the invention a fastening device is provided to fix two members against relative sliding movement and thereby fix the length of the transverse wall at a selected length; in another embodiment of the invention the members are resiliently biased towards an extended condition of the transverse wall but can be slid relative to one another against the resilient bias to a more retracted condition. The resilient bias may be provided by one or more springs or by resilient foam contained within the members. In the case where the members are resiliently biased, the wall may be retracted, then placed in a desired location in the cot and then the wall extended such that ends of the wall become located between bars on side walls of the cot.

The present invention further provides a cot as defined above and further including a mattress and bedding extending over substantially the whole length of the cot, the transverse wall bearing down on the mattress and bedding to define the effective end of the mattress and bedding.

The transverse wall may be provided as part of a cot when the cot is first manufactured and sold. It is also possible, however, to provide the transverse wall as an accessory to be fitted to a cot that has been purchased separately. Accordingly the present invention further provides a cot adjusting device for use in adjusting the effective length of a cot, the device including a transverse wall and securing means for securing the wall across a cot at a position partway along the length of the cot, the transverse wall serving to reduce the effective length of the cot. The cot adjusting device preferably includes the various features defined above with reference to the entire cot.

The present invention further provides a method of adjusting the effective length of a cot, the method including the step of detachably securing a transverse wall to a cot which includes a base, a pair of side walls and a pair of end walls extending above the base, the transverse wall extending across the cot above the base between the side walls at a position partway along the length of the cot, the transverse wall serving to reduce the effective length of the cot. Preferably, the method further includes the step of detaching the transverse wall from the cot and detachably securing it to the cot in another position partway along the length of the cot, the transverse wall serving to reduce the effective length of the cot to a different extent from when in its previous position.

Figure 4:
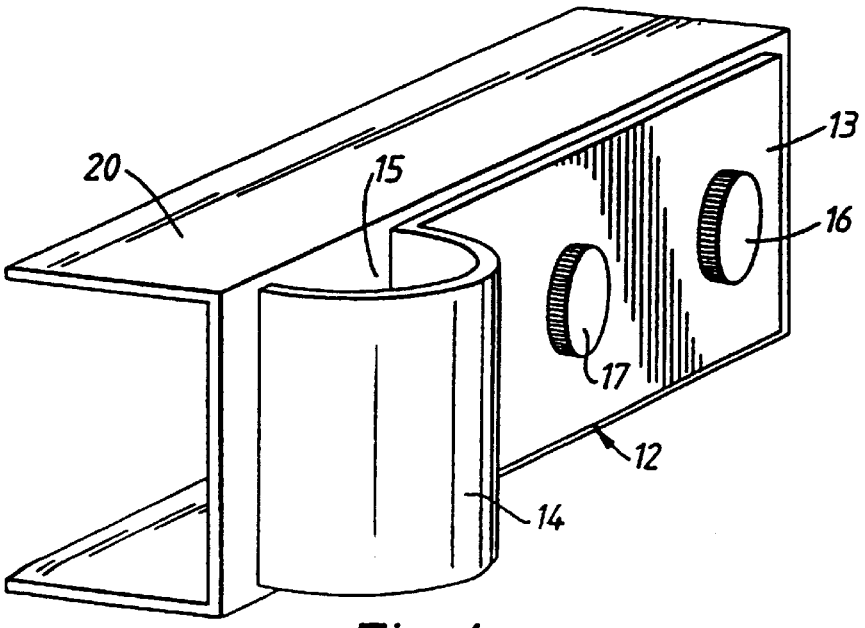
Figure 2:
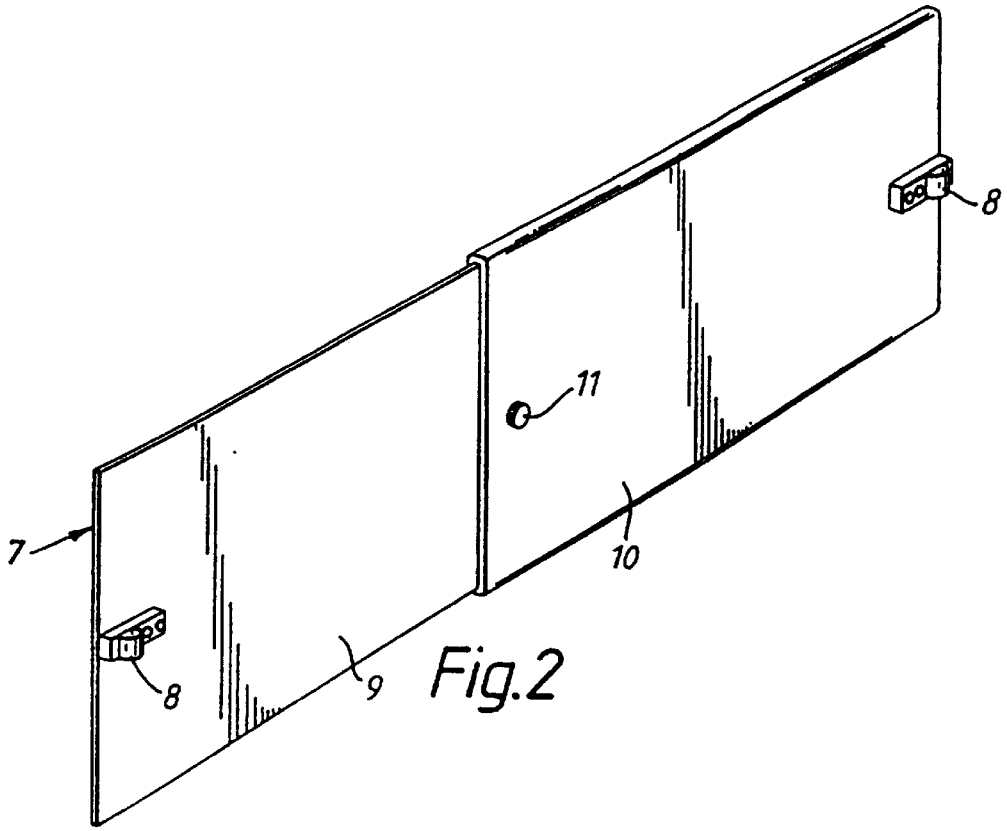
Figure 3:
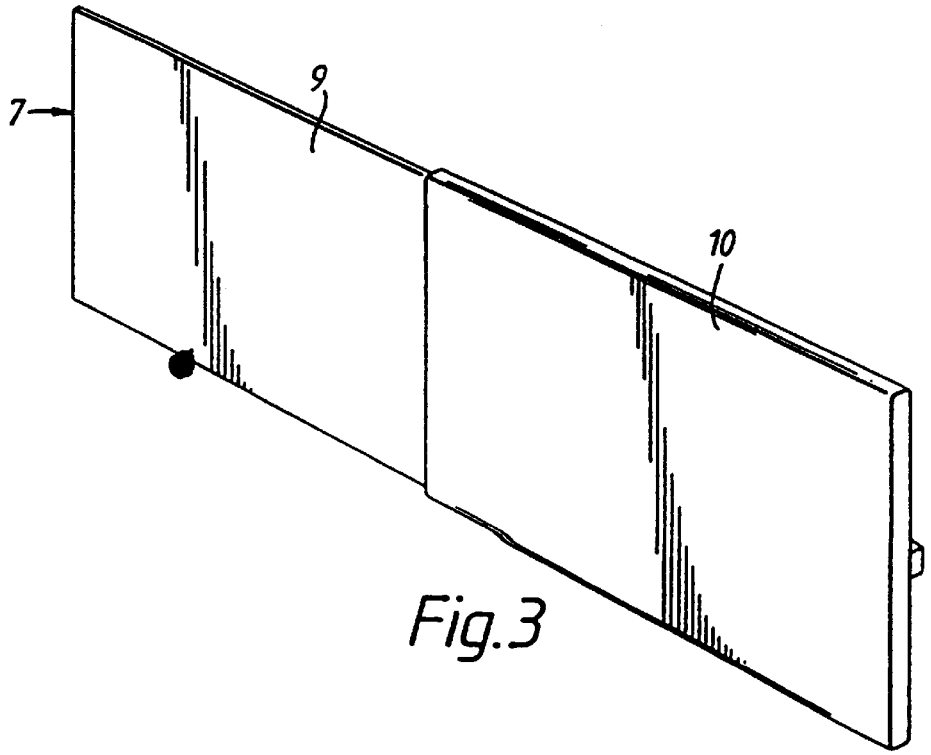
Figure 5:
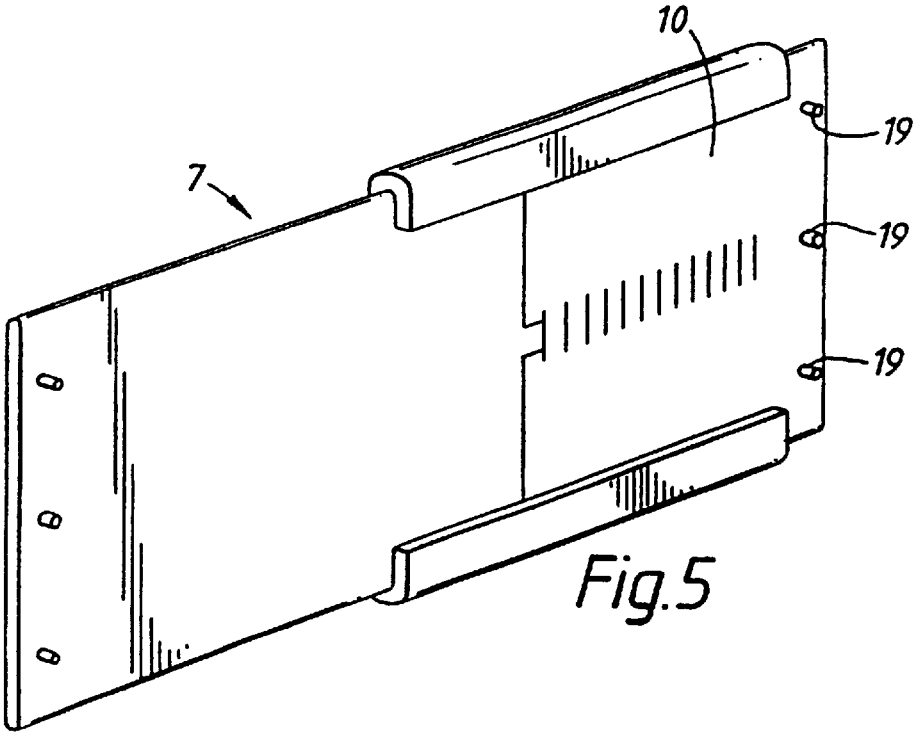
Figure 6:
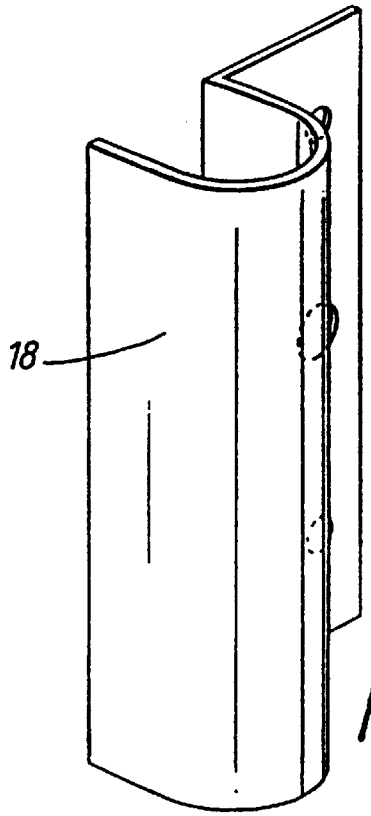
Figure 7:
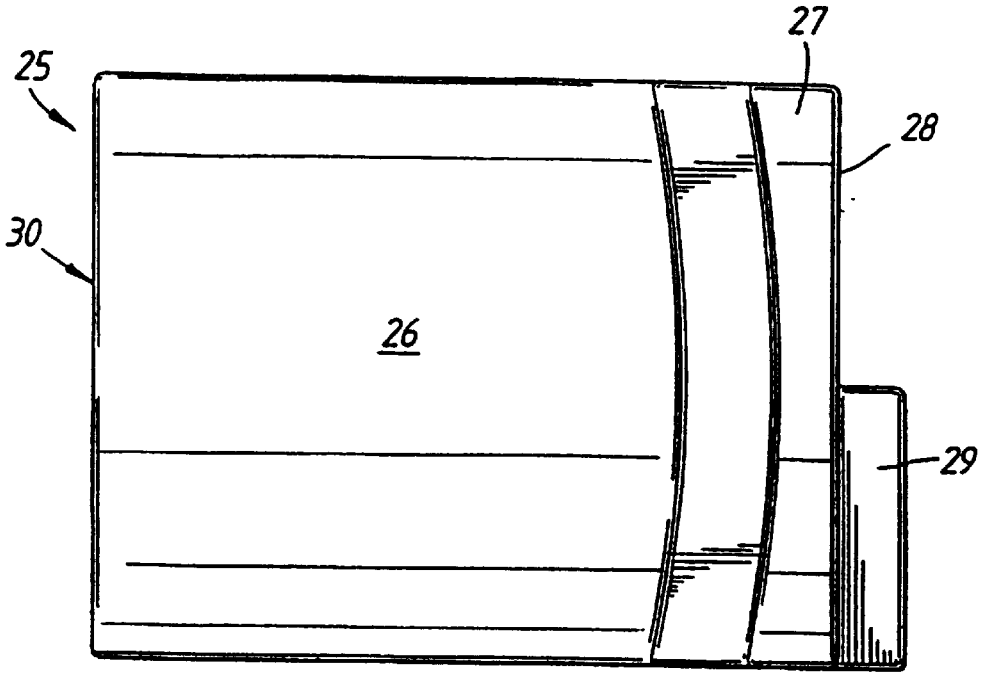
Figure 8:
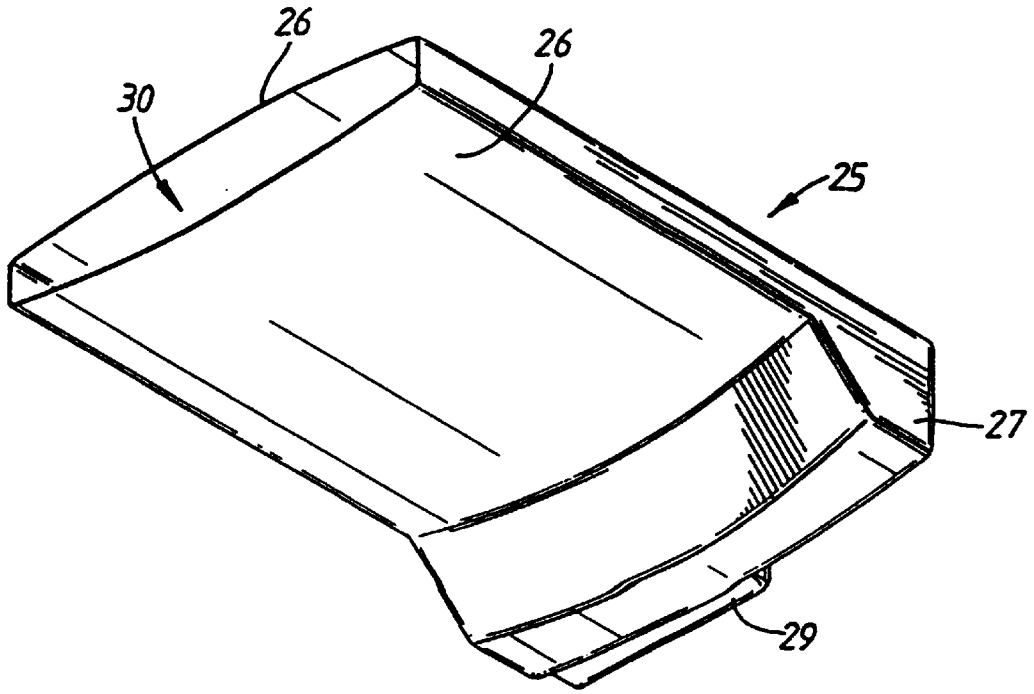
Figure 9:
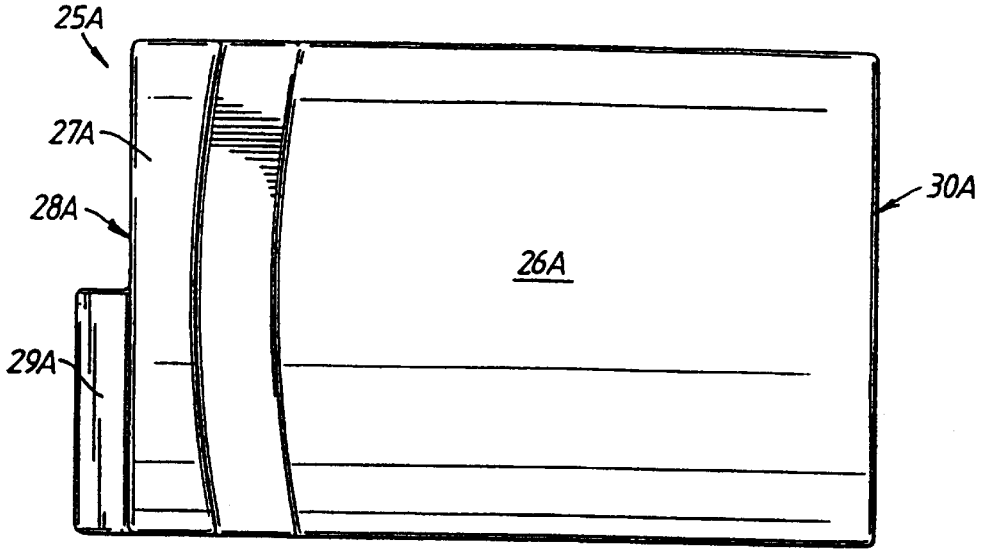
Figure 10:
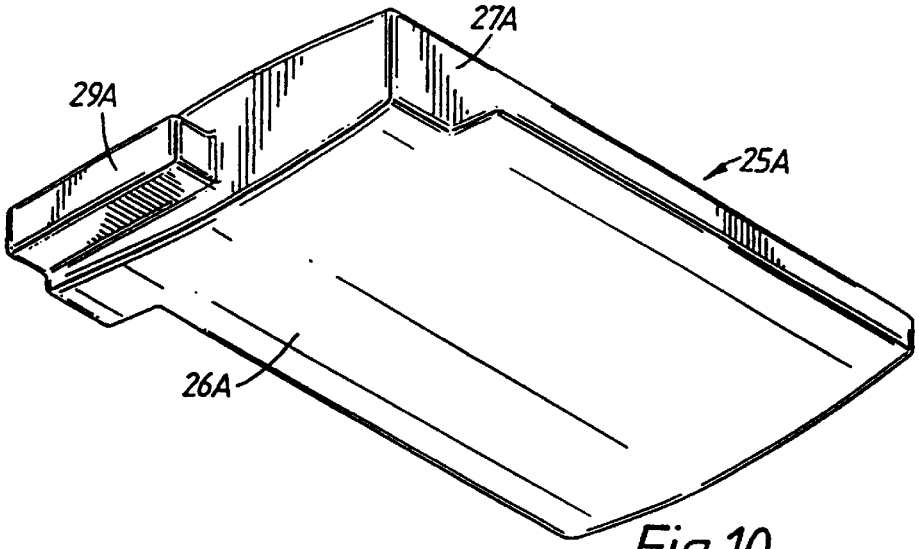
Figure 11:
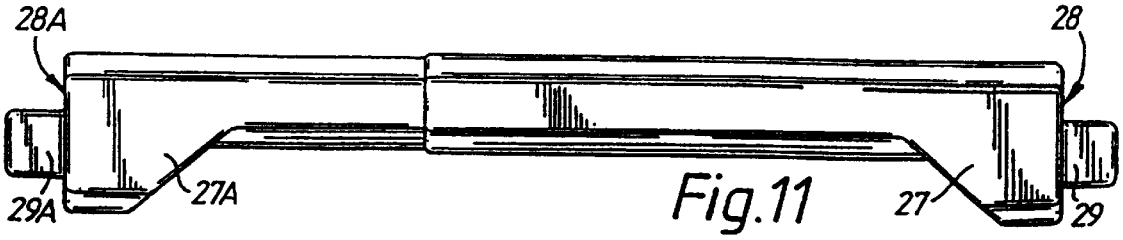
Figure 12:
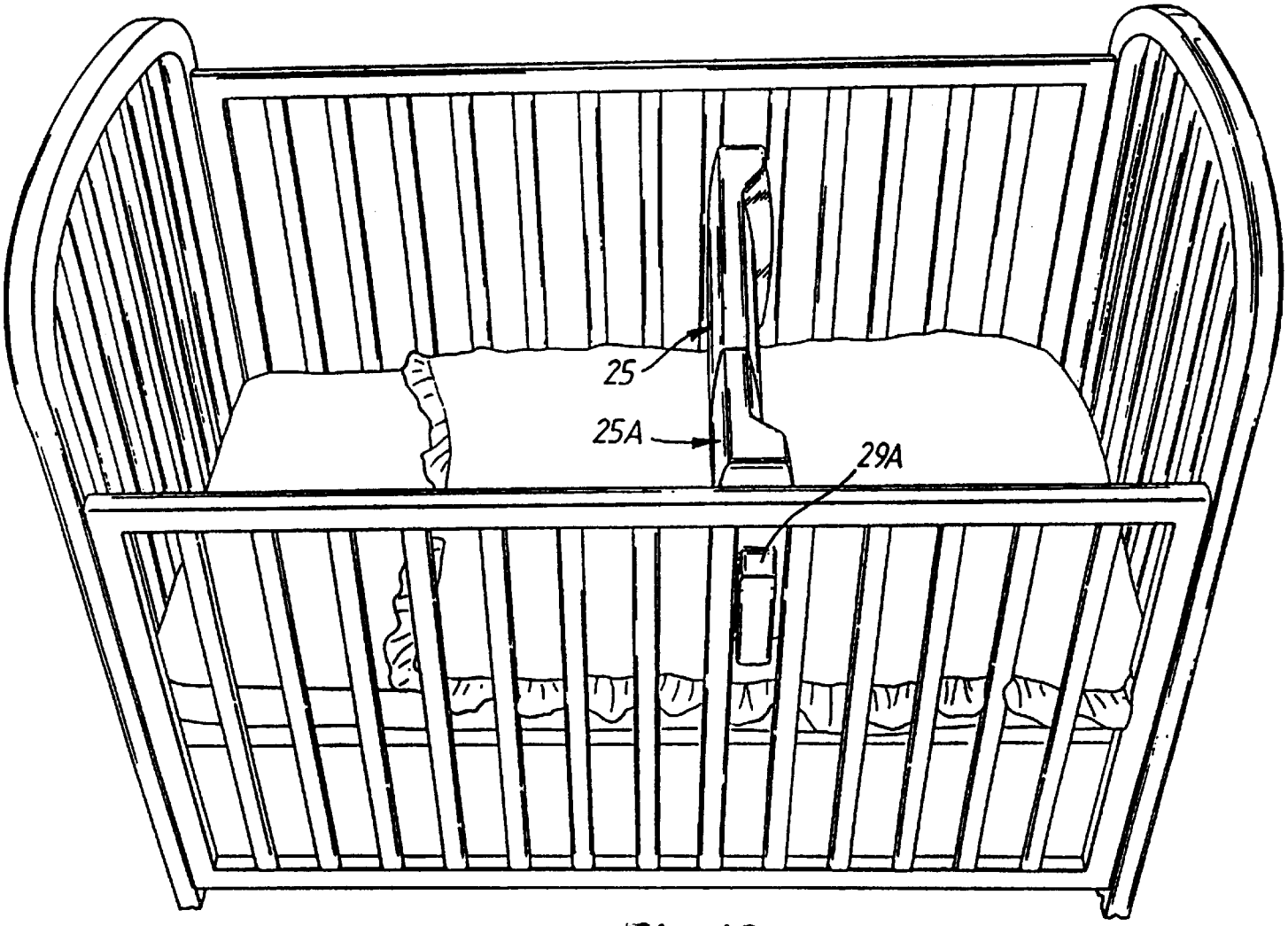

By way of example certain embodiments of the invention will now be described with reference to the accompanying drawings, of which:

FIG. 1 is a perspective view of a cot including a cot length adjusting device fitted thereto, FIG. 2 is a perspective view from the rear of the cot length adjusting device, FIG. 3 is a perspective view from the front of the cot length adjusting device, FIG. 4 is a perspective view of one of the securing devices used to secure the adjusting device to the cot, FIG. 5 is a perspective view from the rear of a modified form of the cot length adjusting device of FIGS. 2 and 3, with the securing devices not attached, FIG. 6 is a perspective view from the rear of a suitable securing device, FIG. 7 is a rear elevation view of a first member of an alternative form of cot length adjusting device, FIG. 8 is a perspective view of the first member of the alternative device, FIG. 9 is a rear elevation view of a second member of the alternative device, FIG. 10 is a perspective view of the second member of the alternative device, FIG. 11 is a plan view of the alternative device with the first and second members assembled together, and FIG. 12 is a perspective view of a cot fitted with the alternative device.

FIG. 1 shows a cot having a top end wall 1, a bottom end wall 2, a pair of side walls 3, 4 including vertical bars 3A, 4A and a base 5. A cot length adjusting device 6 generally comprising a transverse wall 7 and securing devices 8 is provided partway along the length of the cot. As shown in FIGS. 2 and 3 the transverse wall 7 is formed of a pair of telescopic members 9, 10, an inner member 9 being slidably received within an outer member 10. A thumb screw 11 mounted on the back of the outer member 10 can be turned to bear against the inner member 9 and fix the inner and outer members together to prevent relative sliding movement.

At the distal ends of the members 9, 10 respective securing devices 8 are mounted on the back faces of the members. As shown in FIG. 4, each securing device comprises a U shaped bracket 20 and a metal plate 12. The ends of the limbs of the U of the bracket 20 are fixed by suitable means to the members 9, 10. The metal plate 12 has a flat part 13 abutting the bracket 20 and a C shaped end 14 defining with the bracket 20 an opening 15 for receiving a cot bar. The flat part 13 is provided with a pair of thumb screws 16, 17 which pass through the part 13 and are received in screw-threaded holes in the bracket 20 so that tightening of the thumb screws 16, 17 serves to fasten the metal plate 12 tightly to the bracket 20.

The length adjusting device 6 can be secured to the cot at any selected position along the length of the cot where there are bars 3A, 4A. To secure the device 6, the metal plates 12 are detached or loosened from their fastening to the brackets 20 and the transverse wall 7 positioned on the forward sides of a pair of bars 3A, 4A to which the wall 7 is to be attached with the brackets 20 resting against the bars 3A, 4A. The metal plates 13 are then fixed to the brackets 20 with the bars 3A, 4A received in the openings 15 formed between the plates 13 and the brackets 20. When the thumb screws 16, 17 are tightened the transverse wall 7 becomes fixed securely to the side walls 3, 4 of the cot at the selected position.

If the transverse wall 7 has not previously been fitted to the cot it is preferable for the wall to be fitted with the thumb screw 11 loose to allow the transverse wall 7 to adjust in length to match the precise spacing of the side walls 3, 4 of the cot. Once the wall 7 is secured to the sides of the cot the thumb screw 11 can be tightened and should not need any further adjustment unless or until the device 6 is used on a different cot.

Whilst no bedding is shown in FIG. 1, it should be understood that the cot of FIG. 1 is used with ordinary bedding which extends over the full length of the cot. The bedding is arranged with the transverse wall 7 out of the cot or raised towards the top of the bars 3A, 4A. Once the bedding has been arranged the wall 7 is brought back into position, pressed into the bedding and secured in that position by tightening the thumb screws 16, 17. The wall 7 then defines the effective bottom end of the cot so that the effective length of the cot is reduced; in the case of the wall position shown in FIG. 1 the length is about half the full length of the cot. The face of the wall 7 exposed to a child in the cot is free of any projections or the like which might lead to injury of a child. The pressure of the wall 7 on the bedding also assists to keep the bedding in position in the cot.

The wall 7 can easily be raised or removed to allow the bedding to be changed and, as the child grows, the wall 7 can be moved down the cot to successive bars, thereby gradually increasing the length of the cot.

FIGS. 5 and 6 show a modified form of transverse wall 7: firstly the outer telescopic member 10 has an incomplete rear side in order to reduce the cost and weight of the member; secondly the brackets 20 and metal plates 12 are replaced by a single component 18 which is secured over studs 19 by fasteners (not shown) which are secured on the studs 19.

It will be understood that various modifications may be made to the embodiments of the invention described above. For example, other methods of fixing the transverse wall to the cot may be adopted utilizing, for example, known fixing devices that can be fixed and released quickly by hand. The invention can be applied to a cot with a side that can be lowered; in that case, if the transverse wall is secured to the movable side it is of course especially advantageous for the fixing of the transverse wall to the movable side to be quickly releasable.

FIGS. 7 to 12 show an alternative form of cot length adjusting device which is especially simple to manufacture and to use. The device comprises two members moulded from plastics material with one slidably and telescopically mounted in the other. FIGS. 7 and 8 show the outer member 25 which is hollow and blow moulded from plastics material. The member 25 has slightly curved front and rear faces 26. At one end of the member 25, the member is thickened to form an end portion 27 from the end face 28 of which a lug 29 projects. As can be seen in FIGS. 11 and 12, the thickening of the member 25 is at the rear of the member 25. The other end of the member 25, defines an opening 30 for receiving the inner member 25A shown in FIGS. 9 and 10. The inner member 25A is very similar to the member 25 and corresponding parts are referenced by the same reference numeral with the suffix A added. The front and rear faces 26A of the member 25A are very slightly smaller than the faces 26 of the member 25 and the member 25A is therefore able to be received as a sliding fit within the member 25 as shown in FIGS. 11 and 12. Resilient biasing means (not shown) are provided inside the telescopically engaged members 25 and 25A so as to bias the members outwardly from one another. The resilient biasing means may comprise a pair of compression spring assemblies extending between opposite internal end faces in the members 25 and 25A, one spring being towards the top and the other towards the bottom of the members; alternatively the resilient biasing means may consist of foam material. Whilst in the described embodiment the inner member 25A has an open end face 30A and the resilient biasing means extends into both members, it is possible for the end face 30A of the inner member to be closed and for the resilient biasing means to be located within the outer member 25 only, bearing against the closed end face 30A of the inner member 25A. If desired a stop may be provided to limit outward movement of the members 25, 25A relative to one another so that the member 25A is retained at all times partly inside the member 25.

The adjusting device described with reference to FIGS. 7 to 11 is used in substantially the same way as the devices previously described and is shown installed in a cot in FIG. 12. The device is compressed by a user against the resilient bias until the overall width of the device, defined by the distance between the opposite extremities of the lugs 29 and 29A, is less than the internal width of the cot. The lugs 29 and 29A are then placed between selected adjacent bars on opposite sides of the cot, and the members 25 and 25A allowed to move outwardly under the action of the resilient bias until the end faces 28 and 28A of the transverse wall defined by the members 25 and 25A bear against the inner faces of the cot bars. High friction strips or pads (not shown) are provided on the end faces 28 and 28A so that, as a result of the outward biasing force, the opposite ends of the wall are held in a fixed position against the bars. The bottom faces of the members 25 and 25A can also be provided with high friction strips or pads so as to grip bedding below the wall and prevent movement of the bedding under the wall. As will be understood, the device can be simply removed, or its position altered, simply by pressing the members 25 and 25A together against the resilient bias.

What is claimed is:

1. A cot including a base, a pair of side walls and a pair of end walls extending above the base, and a transverse wall movably secured across the cot above the base between the side walls at a position partway along a length of the cot, the transverse wall serving to reduce an effective length of the cot, the transverse wall comprising individual wall sections that are slidably connected together, the transverse wall being adjustable in length by sliding the individual wall sections relative to one another.

2. The cot of claim 1, in which the side walls of the cot include a plurality of upright bars having inner faces and the transverse wall is dimensioned such that it can be secured with its opposite end portions bearing against the inner faces of the cot bars and with parts projecting outwardly from the end portions fitting between adjacent bars.

3. The cot of claim 1 in which the transverse wall is securable across the cot in a plurality of different positions along the length of the cot.

4. The cot of claim 1 in which the transverse wall is detachably secured to the cot.

5. The cot of claim 4, in which the side walls of the cot include a plurality of upright bars and the transverse wall is secured to bars of the side walls of the cot.

6. The cot of claim 1, in which the side walls of the cot include a plurality of upright bars and the transverse wall is secured in place by the bars of the side walls of the cot.

7. The cot of claim 6 in which the transverse wall is secured in place by opposite ends of the wall fitting between adjacent bars of the cot.

8. The cot of claim 7, in which the opposite ends of the transverse wall press outwardly against the side walls of the cot.

9. The cot of claim 1, in which the transverse wall is secured to the cot in a manner that prevents vertical movement of the transverse wall when it is fully secured.

10. The cot of claim 1, in which a height to which the transverse wall extends above the base of the cot is substantially less than a height to which the side walls and end walls extend above the base.

11. The cot of claim 1, in which the transverse wall is substantially solid.

12. The cot of claim 1, in which the transverse wall extends across substantially from one side wall to the other.

13. The cot of claim 1, in which a fastening device is provided to fix the transverse wall at a selected length.

14. The cot of claim 1, in which the individual wall sections are resiliently biased towards an extended condition of the transverse wall.

15. The cot of claim 14, in which the individual wall sections are resiliently biased by one or more springs.

16. The cot of claim 14, in which the individual wall sections are resiliently biased by resilient foam contained within the individual wall sections.

17. The cot of claim 14, in which the individual wall sections can be slid relative to one another against the resilient bias to a more retracted condition.

18. A The cot of claim 1, further including a mattress and bedding extending over substantially the whole length of the cot, the transverse wall bearing down on the mattress and bedding to define an effective end of the mattress and bedding.

* * * * *